US005186505A

United States Patent [19]

Chu

[11] Patent Number: 5,186,505

[45] Date of Patent: Feb. 16, 1993

[54] CHUCKING DEVICE OF RACKET STRINGING MACHINE

[76] Inventor: David T. Chu, 150, Chung Chen Rd., Taichung, Taiwan

[21] Appl. No.: 848,463

[22] Filed: Mar. 9, 1992

[51] Int. Cl.[5] ..... A63B 51/14

[52] U.S. Cl. ..... 273/73 A

[58] Field of Search ..... 273/73 R, 73 A, 73 B

[56] References Cited

U.S. PATENT DOCUMENTS

| | | | |
|---|---|---|---|
| 3,988,022 | 10/1976 | Halbrook | 273/73 A |
| 4,417,729 | 11/1983 | Morrone | 273/73 A |
| 4,706,955 | 11/1987 | Ngadi et al. | 273/73 A |
| 4,846,474 | 7/1989 | Chiang | 273/73 A |
| 5,090,697 | 2/1992 | Lee | 273/73 A |

FOREIGN PATENT DOCUMENTS

| | | | |
|---|---|---|---|
| 776832 | 6/1933 | Australia | 273/73 A |
| 3102658 | 12/1981 | Fed. Rep. of Germany | 273/73 A |
| 3706249 | 9/1988 | Fed. Rep. of Germany | 273/73 A |
| 2523457 | 9/1983 | France | 273/73 A |

*Primary Examiner*—V. Millin

*Assistant Examiner*—William E. Stoll

*Attorney, Agent, or Firm*—Browdy and Neimark

[57] ABSTRACT

An improved chucking device for a racket stringing machine is mounted on the chucking arm of the racket stringing machine. The chucking arm comprises a sliding track located at the place where the chucking device is mounted and two lugs extending downward from the bottom surface thereof and by both sides of the sliding track. Each chucking device comprises a sliding block having a predetermined number of arresting holes, a clamping block disposed on the sliding block to fasten a racket frame, a pivotal member having a threaded hole, a threaded rod inserted into the threaded hole of the pivotal member in an inclined manner so that it urges against the arresting hole of the sliding block, and a torsion spring located between the pivotal member and the lugs so as to permit the threaded rod to keep urging against the arresting hole. A racket frame can be fastened or released rapidly by relieving the threaded rod of the action of urging against the arresting hole so that the sliding block is allowed to slide rapidly.

10 Claims, 4 Drawing Sheets

CHUCKING DEVICE OF RACKET STRINGING MACHINE

BACKGROUND OF THE INVENTION

The present invention relates to a racket stringing machine, and more particularly to an improved chucking mechanism of the racket stringing machine.

As shown in FIG. 1 provided herein, a racket stringing machine of prior art comprises a stationary chucking arm 12 provided thereon with a chucking means 14, which is composed of a base 16 pivotally attached to the chucking arm 12 and of a threaded rod 18 pivotally arranged at the top end of the base 16 and provided at front end thereof with a jaw 19. A racket frame can be clamped to or released from the chucking means 14 by rotating the threaded rod 18 in a forward direction or a backward direction. Such maneuvers are extremely time-consuming and inconvenient.

In addition, the chucking means 14 described above is not suitable for use in clamping a relatively new racket frame 10 as shown in FIG. 2. Such racket 10 has a frame of uneven thickness. For example, the points A and C of the frame have thickness of 22 mm respectively, while the points B and D of the frame have thickness of 30 mm respectively. As shown in FIG. 3, the racket frame 10 is held by the chucking means 14, with points B and D of the racket frame 10 positioned on the chucking arm 12 and with points A and C suspended. Therefore, points A, B, C and D must be clamped securely at the same time so that the racket 10 can be held firmly by the chucking means 14. However, points A and C are devoid of support and are therefore vulnerable to deformation when acted on with force.

SUMMARY OF THE INVENTION

It is therefore the primary objective of the present invention to provide a racket stringing machine with an improved chucking mechanism capable of clamping and releasing a racket frame easily and rapidly.

It is another objective of the present invention to provide a racket stringing machine with an improved chucking mechanism capable of giving adequate support to the suspended points of a racket frame having uneven thickness.

In keeping with the principles of the present invention, the foregoing objectives of the present invention are accomplished by an improved chucking mechanism of racket stringing machine having chucking arms, each of which is provided with a predetermined number of chucking means. The chucking arm is furnished with a sliding track located at the position corresponding to each chucking means in such a manner that it faces toward the directions in which the clamping and the releasing of racket frame take place. The chucking arm is further provided on the reverse thereof with two lugs extending downward. Each of chucking means comprises a sliding block, a clamping block, a pivotal member, a threaded rod, and a torsion spring. The sliding block comprises axially a predetermined number of arresting holes located on the reverse thereof. The sliding block is slidably disposed in the sliding track. The clamping block is pivotally arranged on the sliding block so as to fasten the racket frame. The pivotal member of columnar construction is arranged pivotally and horizontally in circular holes of the lugs and is provided radially with a thread hole. The threaded rod is driven into the thread hole of the pivotal member in such a manner that it is positioned upwardly at a predetermined angle so as to be caught in the arresting hole of the sliding block. The torsion spring is located between the pivotal member and the lugs with a view to keeping the threaded rod to urge against the arresting hole.

The sliding block can be actuated to move rapidly by pressing the free end of the threaded rod so as to allow the sliding block to be free from being urged against. As a result, the racket frame is clamped or released rapidly by the chucking arm of the racket stringing machine.

The racket stringing machine of the present invention is further characterized in that its clamping block is provided on an upright surface thereof with a V-shaped clamping slot and with a retaining face of an inclination located on another upright surface thereof, and that its rod member is pivotally arranged on the top surface of sliding block by passing through the clamping block, with head portion of rod member remaining a distance from the top surface of clamping block so as to permit the clamping block to move upward and downward along the rod member.

An ordinary racket frame can be clamped securely by the V-shaped clamping slot or by the retaining face which presses the top surface of the sliding block. A special racket frame having an uneven thickness is held by the stringing machine in such manners that the thicker portions of the racket frame are clamped by the retaining face and that the thinner portions are held by the clamping slot. As a result, all clamped portions of the racket frame are well supported so as to prevent them from deforming when worked on.

The foregoing objectives, features and functions will be better understood by studing the following detailed description of a preferred embodiment of the present invention, in conjunction with the drawings provided herewith.

DETAILED DESCRIPTION OF THE PREFERRED EMBODIMENT

Figure 1:
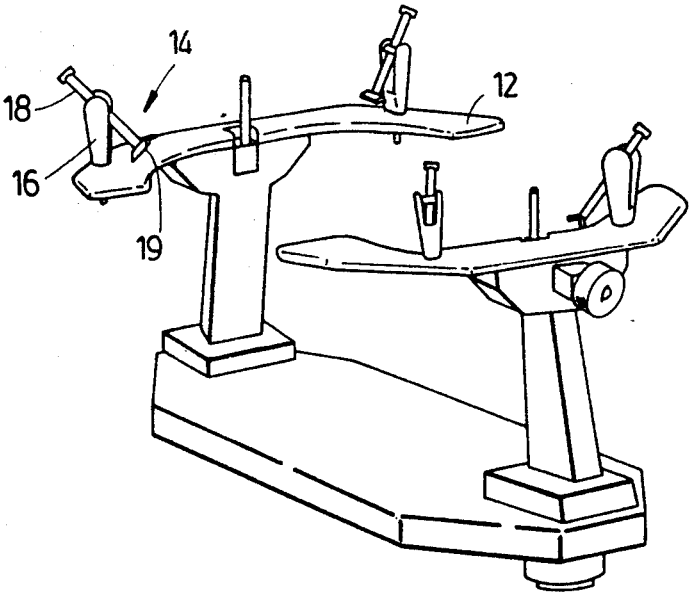
FIG. 1 PRIOR ART
FIG. 1 shows a three-dimensional view of a racket stringing machine of prior art.
Figure 2:
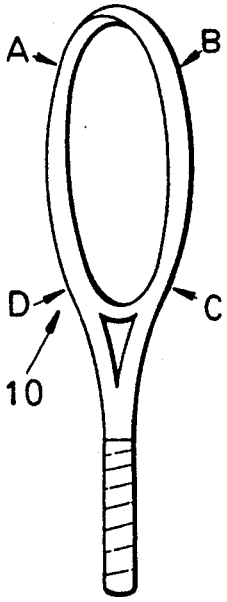
FIG. 2 PRIOR ART
FIG. 2 shows a schematic view of a prior art racket.
Figure 3:
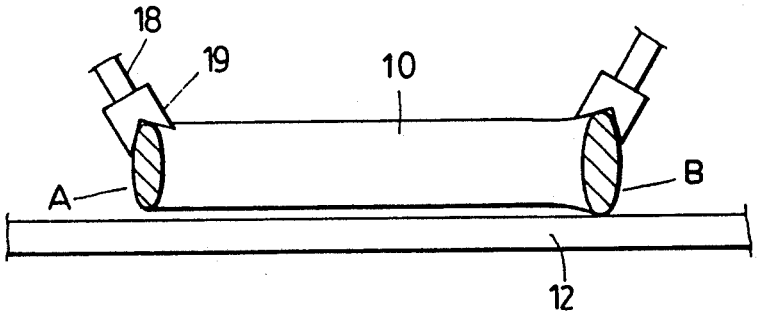
FIG. 3 PRIOR ART
FIG. 3 is a schematic view showing that a prior art racket of FIG. 2 is held by chucking means.
Figure 4:
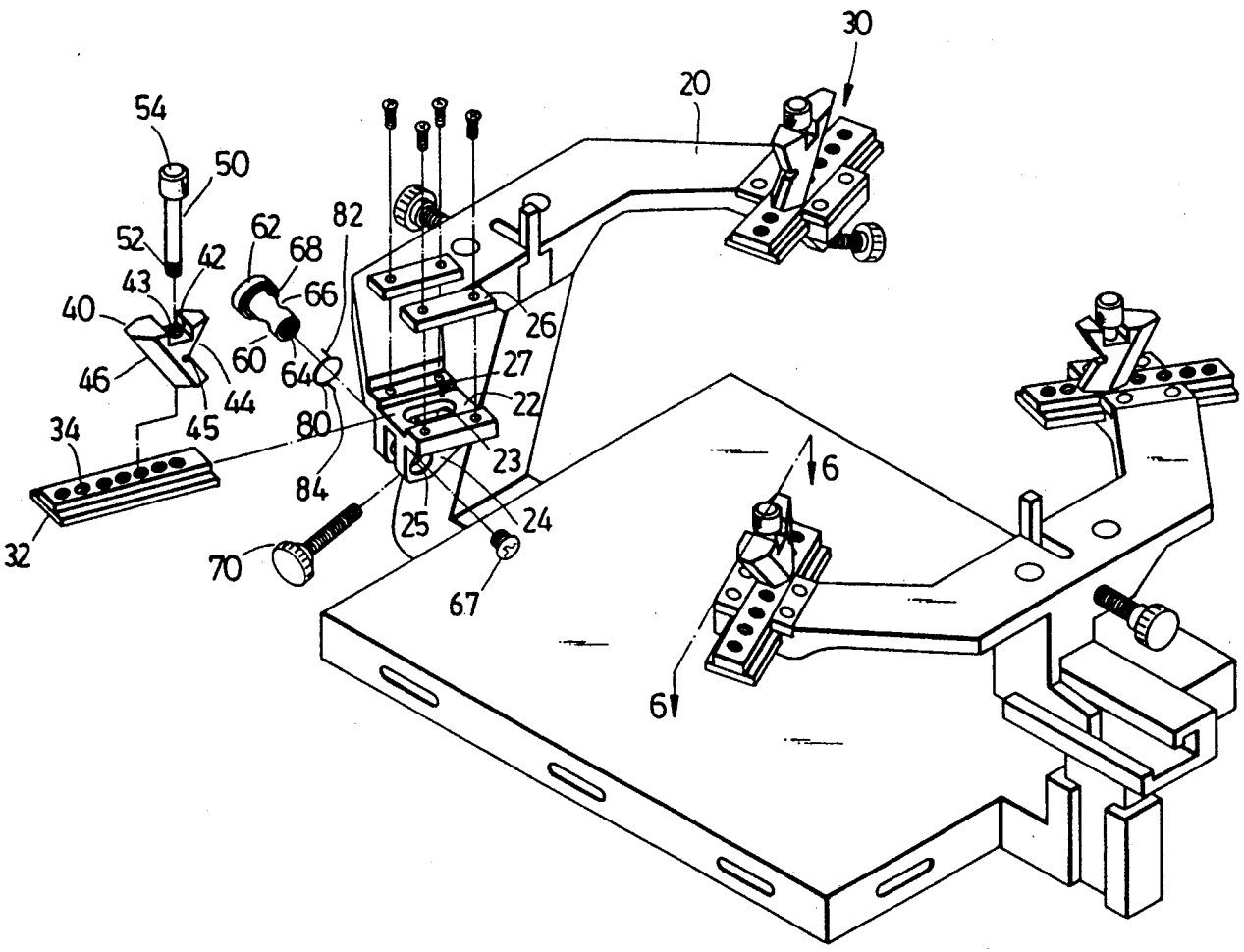
FIG. 4 shows an exploded view of a racket stringing machine of the present invention.
Figure 5:
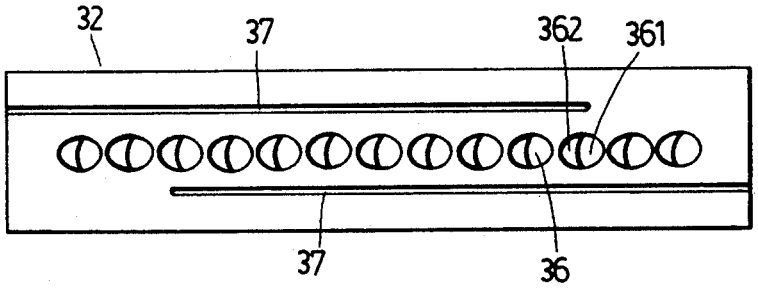
FIG. 5 shows a bottom view of the sliding block as shown in FIG. 4.
Figure 6:
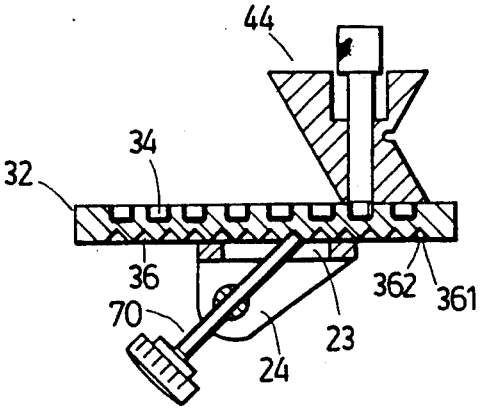
FIG. 6 shows a sectional view of a portion taken along the line 6—6 as shown in FIG. 4.

Referring to FIGS. 4–6, an improved chucking means 30 of racket stringing machine of the present invention is shown mounting on a chucking arm 20 of racket stringing machine. The chucking arm 20 comprises two chucking means 30 mounted separately on the opposite ends thereof. The chucking arm 20 is further provided with a sliding track 22, which is located correspondingly to the chucking means 30 and faces toward the directions in which the racket frame is clamped and released. The bottom wall of sliding track 22 has an elongate through hole 23. Located by both sides of the through hole 23 are two lugs 24 extending downward, with each of two lugs 24 provided coaxially with a circular hole 25. Two arresting blocks 26 are arranged by both sides of the sliding track 22 so that the sliding track 22 has a cross section of an inverted T.

The chucking means 30 comprises a sliding block 32, a clamping block 40, a rod member 50, a pivotal member 60, a threaded rod 70, and a torsion spring 80.

The sliding block 32 of elongate body has a shape of an inverted T in its cross section, a length which is longer than the width of the chucking arm 20, a predetermined number of threaded pivot holes 34 spaced equidistantly and disposed axially on the top surface thereof, and a predetermined number of arresting holes 36 spaced equidistantly and disposed axially on the bottom surface thereof. Each of the arresting holes 36 is constructed in such a manner that it consists of a first bevel 361 and a second bevel 362. The sliding block 32 is further provided with two elongate narrow slots 37 arranged by both sides of a row of arresting holes 36, with one end of each of narrow slots 37 terminating inside the sliding block 32 and with other end of each of narrow slots 37 terminating at the borderline of the sliding block 32, as shown in FIG. 5. The sliding block 32 is fittingly disposed in the sliding track 22. The two narrow slots 37 are united respectively with the two protrusions 27 located at the bottom of the sliding track 22. The pivot holes 34 are exposed. The sliding block 32 moves along the sliding track 22 in such a way that its movement terminates at the two protrusions 27.

The clamping block 40 of plastic material comprises a recessed portion 42 having therein an axial hole 43, a V-shaped clamping slot 44 in the upright surface thereof, a thread receiving slot 45 located horizontally at the junction of the two plane surfaces of the clamping slot 44, and a beveled retaining face 46 in its upright surface which is opposite to the upright surface in which the clamping slot 44 is located.

The rod member 50 of a predetermined length is provided at its tail end with a threaded portion 52 engageable with the threaded pivot holes 34 of the sliding block 32 by passing through the axial hole 43 of the clamping block 40 so as to permit the clamping block 40 to be arranged adjustably on the sliding block 32. The machine operator can use either the clamping slot 44 or the retaining face 46 to clamp the racket frame by rotating the clamping block 40. The recessed portion 42 of the clamping block 40 receives therein the head portion 54 of the rod member 50 so that the clamping block 40 can be slided in an up-and-down manner along the rod member 50.

The pivotal member 60 of cylindrical construction is provided at one end thereof with a cap 62 and with a connection hole 64 at other end thereof and further with a threaded hole 66 disposed radially in the body thereof. The pivotal member 60 is placed through the coaxial circular holes 25 of the two lugs 24 in such manners that the threaded hole 66 of the pivotal member 60 is located between the two lugs 24 and that the pivotal member 60 can be rotated in the circular holes 25. A screw 67 engageable with the connection hole 64 is used to help retain the pivotal member 60.

The threaded rod 70 has a free end engageable with the threaded hole 66 of the pivotal member 60 in an inclined manner that it passes through the through hole 23 of the chucking arm 20 to urge against the arresting hole 36.

The torsion spring 80 is fitted over the pivotal member 60, with its one end 82 secured to a small hole 68 located in the inner wall surface of the cap 62 of the pivotal member 60 and with its other end 84 secured to a small hole (not shown in the drawing provided) located in the wall surface of a lug 24. The pivotal member 60 is rotated by means of the torsion spring 80, which in turn is responsible for keeping the threaded rod 70 to urge against the arresting hole 36 at the time when the threaded rod 70 is free from being exerted on by an external force.

Figure 7:
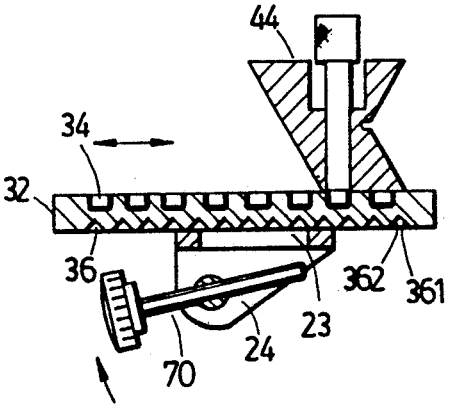
FIG. 7 shows the portion, as shown in FIG. 6, at work.

It is recommended that the top surfaces of arresting blocks 26 and sliding block 32 are covered with plastic membranes to protect the racket frame. Before clamping the racket frame, an operator should push inwardly the sliding block 32 so that the threaded rod 70 urges against the arresting hole 36 in such a manner that the second bevel 362 of the arresting hole 36 exerts downward a pressure on the free end of the threaded rod 70 so as to cause the sliding block 32 to slide downward and to actuate the clamping block 40 to move rapidly toward the outer edge of the racket frame to be fastened. The coordinated action of the sliding block 32 and the threaded rod 70 is brought about in such a way that is similar to the action of a ratchet wheel. When the threaded rod 70 urges against the arresting hole 36, the sliding block 32 can be pushed forward only and can not be moved backward on the grounds that the threaded rod 70 urges against the first bevel 361 of the arresting hole 36. However, the sliding block 32 can be moved forward, as shown in FIG. 7, by pushing upwardly the head portion of the threaded rod 70 so as to allow the free end of the threaded rod 70 to be free from urging against the arresting hole 36.

It must be noted that an action causing the clamping block 40 to move rapidly toward the outer edge of the racket frame intended to be fastened does not ensure that the racket frame will be clamped with precision, in view of the fact that there is still a gap between the clamping surface of the clamping block 40 and the racket frame. Therefore, a fine adjustment is called for and can be achieved by rotating the threaded rod 70 to move axially so as to urge against the arresting hole 36 and to move the sliding block 32 forward, thereby causing the clamping block 40 to fasten the racket frame with precision.

Figure 8:
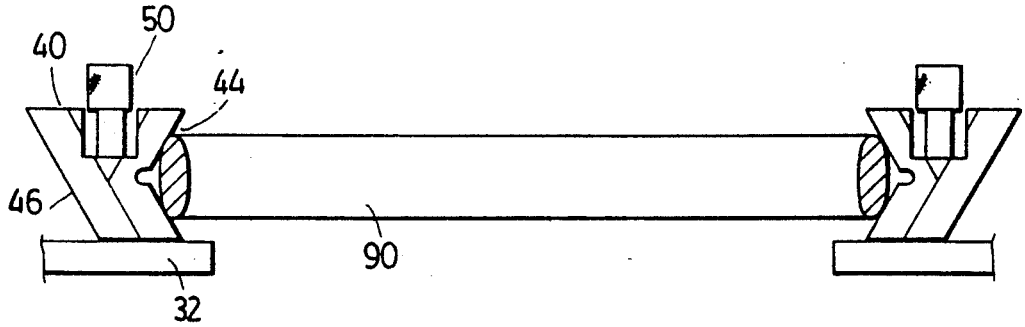
FIG. 8 shows a schematic view of the present invention holding an ordinary racket frame.
Figure 9:
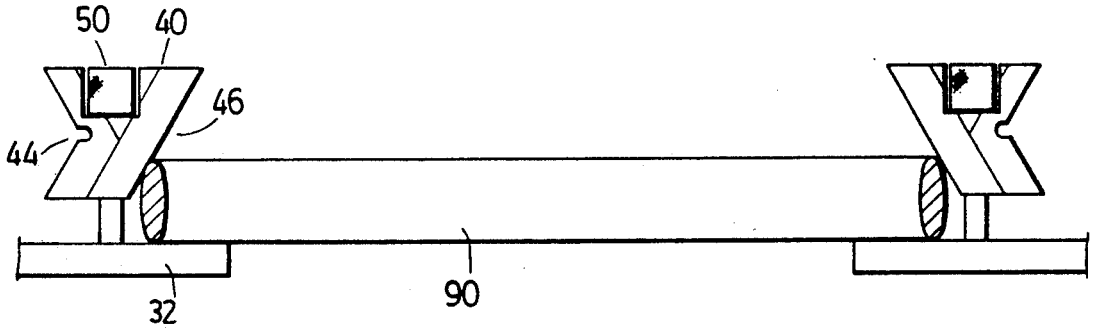
FIG. 9 is the same as the FIG. 8.

As shown in FIG. 8 or FIG. 9, a racket frame 90 having an even thickness is fastened by means of the V-shaped clamping slots 44. The clamping block 40 is rotated for an angle of 180 degrees so that its retaining face 46 faces inwardly to form a clamping space in conjunction with the sliding block 32, and that its retaining face 46 puts pressure on the racket frame 90 so as to cause the bottom of the racket frame 90 to rest securely on the sliding block 32.

As shown in FIG. 8, the racket frame 90 can be released upon having been stringed. This is done by pushing upwardly the head portion of the threaded rod 70 so as to cause the free end of the threaded rod 70 to move downward to terminate its action of urging against the arresting hole 36. As a result, the sliding block 32 is free to slide, thereby resulting in the rapid release of the racket frame 90.

Figure 10:
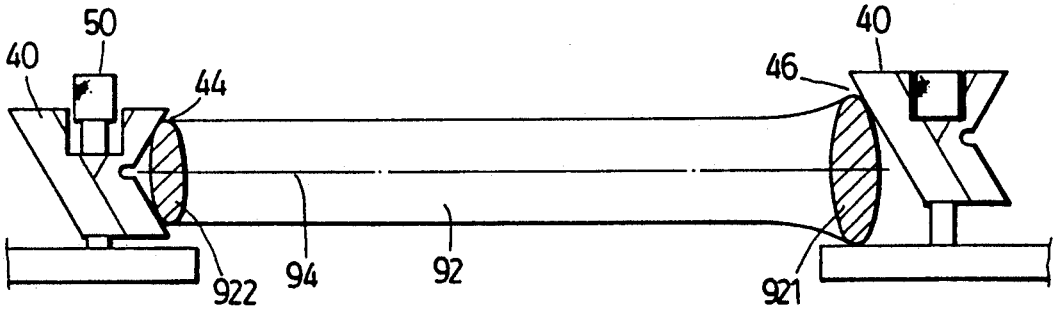
FIG. 10 shows a schematic view of the present invention holding a racket frame having an uneven thickness.

Now referring to FIG. 10, the thick portion 921 of the racket frame 92 having an uneven thickness is shown being clamped by the retaining face 46 of the clamping block 40. On the other hand, the thin portion 922 of the racket frame 92 is fastened by the V-shaped clamping slot 44 of the clamping block 40 which can be adjusted upward or downward along the rod member 50 in accordance with the height of the thin portion 922. In other words, the position of the clamping block 40 can be adjusted on the basis of the center line 94 of the racket frame 92 so that all clamped portions of the racket frame 92 are well supported so as to prevent them from being deformed when worked on. To release the clamped racket frame 92, just follow the procedures of releasing the clamped racket frame 90 as described previously.

The sliding block 32 is designed to move in a defined range. In order to permit the clamping block 40 to fasten the racket frame easily and rapidly, the position of the clamping block 40 in the pivot hole 34 of the sliding block 32 can be changed according to the dimension of a racket frame intended to be fastened.

The embodiment of the present invention described above is to be considered in all respects as merely illustrative and not restrictive. Accordingly, the present invention is to be limited only by the scope of the hereinafter appended claims.

I claim:

1. An improved racket stringing machine comprising means for chucking, said chucking means mounted on a chucking arm of said stringing machine, said chucking arm comprising a predetermined number of said chucking means and a sliding track located correspondingly to each of said chucking means and facing toward the directions in which a racket frame is fastened and released, said sliding track having a longitudinal slot with an upper width being narrower than a lower width, said sliding track having a through hole located at the center thereof, said chucking arm further comprising two lugs extending downward by both sides of said through hole of said sliding track, with each of said lugs provided with a circular hole, each of said chucking means further comprising:

(a) a sliding block having an elongated body and cross-sectional profile corresponding to that of said longitudinal slot of said sliding track, said sliding block having a predetermined number of arresting holes disposed axially and spaced apart equidistantly on the bottom surface thereof, said sliding block received in said sliding track in such a manner that it slides along said sliding track;

(b) a clamping block disposed on said sliding block in such a manner that it moves in conjunction with said sliding block;

(c) a pivot member of cylindrical construction having a threaded hole disposed radially and located between said two lugs at the time when said pivot member is arranged horizontally and pivotally in said circular holes of said lugs;

(d) a threaded rod having a free end engageable with said threaded hole of said pivotal member in an inclined manner that it passes through said through hole of said sliding track to urge against said arresting hole; and (e) a torsion spring fitted over said pivotal member and located between said pivotal member and one of said lugs to press against said threaded rod to urge against said arresting hole.

2. An improved racket stringing machine according to claim 1 wherein said clamping block comprises an axial hole, a V-shaped clamping slot in an upright surface thereof, a beveled retaining face in another upright surface thereof, and a thread receiving slot located at the junction of two plane surfaces of said clamping slot; wherein said chucking means further comprising a rod member of a length with a head portion received in said axial hole of said clamping block, said length of said rod member being longer than that of said axial hole of said clamping block so as to permit said clamping block to move upward and downward along said rod member.

3. An improved racket stringing machine according to claim 1 wherein said arresting hole has a first bevel and a second bevel.

4. An improved racket stringing machine according to claim 2 wherein said arresting hole is composed of a first bevel and a second bevel.

5. An improved racket stringing machine according to claim 2 wherein said sliding block comprises axially a predetermined number of pivot holes spaced equidistantly on a top surface thereof.

6. An improved racket stringing machine according to claim 1 wherein said sliding track comprises protrusions located respectively on each of both sides of said through hole thereof, and wherein said sliding block comprises two narrow slots, with one end of each of said narrow slots terminating inside said sliding block and with other end of each of said narrow slots terminating at a borderline of said sliding block, and with said narrow slots united with said protrusions.

7. An improved racket stringing machine according to claim 2 wherein said sliding track comprises protrusions located respectively on each of both sides of said through hole thereof, and wherein said sliding block comprises two narrow slots, with one end of each of said narrow slots terminating inside said sliding block and with other end of each of said narrow slots terminating at a borderline of said sliding block, and with said narrow slots united with said protursions.

8. An improved racket stringing machine according to claim 2, wherein said clamping block comprises a recessed portion located correspondingly to said axial hole to receive said head portion of said rod member.

9. An improved racket stringing machine according to claim 5 wherein said clamping block comprises a recessed portion located correspondingly to said axial hole to receive said head portion of said rod member.

10. An improved racket stringing machine according to claim 4 wherein said sliding block comprises axially a predetermined number of pivot holes spaced equidistantly on a top surface thereof.

* * * * *